US010550812B2

(12) United States Patent
Wieschollek

(10) Patent No.: US 10,550,812 B2
(45) Date of Patent: Feb. 4, 2020

(54) STIFFENED FUEL INJECTOR

(71) Applicant: ROBERT BOSCH GMBH, Stuttgart (DE)

(72) Inventor: Sebastian Wieschollek, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 272 days.

(21) Appl. No.: 14/381,555

(22) PCT Filed: Feb. 12, 2013

(86) PCT No.: PCT/EP2013/052773

§ 371 (c)(1),
(2) Date: Aug. 27, 2014

(87) PCT Pub. No.: WO2013/143750

PCT Pub. Date: Oct. 3, 2013

(65) Prior Publication Data

US 2015/0013645 A1 Jan. 15, 2015

(30) Foreign Application Priority Data

Mar. 27, 2012 (DE) ..... 10 2012 204 920

(51) Int. Cl.
*F02M 61/14* (2006.01)

(52) U.S. Cl.
CPC ..... *F02M 61/14* (2013.01)

(58) Field of Classification Search
USPC ..... 123/470, 472; 239/533.2, 585.1–585.5
See application file for complete search history.

(56) References Cited

U.S. PATENT DOCUMENTS 5,479,900 A * 1/1996 Bodenhausen ..... F02M 51/005 123/470
6,299,079 B1 * 10/2001 Noller ..... F02M 51/005 123/472
2013/0186986 A1 7/2013 Wolff et al.

FOREIGN PATENT DOCUMENTS

DE 102009000139 A1 7/2009
DE 10 2008 040 843 2/2010
DE 10 2009 038 429 2/2011
DE 10 2010 031 277 1/2012
DE 102010031277 A1 * 1/2012 ..... F02M 51/005
JP 62-177543 U 11/1987
JP H0183168 U 6/1989
JP 3922413 B2 11/1999

(Continued)

OTHER PUBLICATIONS

Machine Translation of DE102010031277A1 PDF File Name: "DE102010031277A1_Machine_Translation.pdf".*

(Continued)

*Primary Examiner* — Stephen K Cronin
*Assistant Examiner* — Ruben Picon-Feliciano
(74) *Attorney, Agent, or Firm* — Norton Rose Fulbright US LLP; Gerard Messina

(57) ABSTRACT

A fuel injector for the injection of fuel, which includes a fuel supply element for supplying the fuel, a current bar which extends at least partially parallel to the fuel supply element, and an extrusion coat, which surrounds the fuel supply element and the current bar, the extrusion coat encompassing a longitudinal rib that extends in the axial direction of the fuel injector and is disposed on the fuel injector opposite the current bar.

22 Claims, 3 Drawing Sheets

(56) References Cited

FOREIGN PATENT DOCUMENTS

| | | | |
|---|---|---|---|
| JP | 2000-291505 | A | 10/2000 |
| JP | 2007-016774 | A | 1/2007 |
| JP | 3901683 | B2 | 4/2007 |
| JP | 3955030 | B2 | 8/2007 |
| JP | 3959088 | B2 | 8/2007 |
| JP | 2011122462 | A | 6/2011 |

OTHER PUBLICATIONS

International Search Report, PCT International Application No. PCT/EP2013/052773, dated Apr. 19, 2013.

* cited by examiner

STIFFENED FUEL INJECTOR

FIELD

The present invention relates to a stiffened fuel injector for the injection of fuel into an internal combustion engine.

BACKGROUND INFORMATION

Fuel injectors in various embodiments are available. The fuel injectors can be disposed directly at the combustion chamber. Two installation forms exist in this context, i.e., an installation from the side on the one hand, and from above on the other, in the vicinity of the intake and/or discharge valves and the spark plug. Because of the installation situation, the fuel injectors disposed on the sides are short, and the fuel injectors placed from above have a long design.

Since the fuel injectors have to generate a defined spray inside the combustion chamber, the utmost care must be taken when installing the fuel injectors. In particular a concentricity in the axial direction of the fuel injector of a sealing element at the cylinder head, especially a Teflon ring, with respect to a sealing element, in particular an O-ring, or a connecting piece on the fuel injector must be ensured. However, especially in the case of long fuel injectors, there is the risk that the fuel injector buckles and therefore warps once the extrusion coating that envelops in particular a fuel supply pipe and an electrical current bar has been applied. The danger increases with the length of the fuel injector, and a resulting concentricity of the fuel injector with an axial axis is therefore no longer able to be ensured.

SUMMARY

An example fuel injector according to the present invention may have the advantage of providing a precise concentricity with a longitudinal axis (axial axis). In accordance with the present invention, the fuel injector, which is produced from different materials, is partially enveloped by an extrusion coat, which includes a longitudinal rib that extends in the axial direction of the fuel injector. The extrusion coat also surrounds a current bar which establishes an electrical connection between a plug connector and an electrical consumer, especially a magnet armature. By providing the longitudinal rib, it is therefore possible to realize stiffening of the extrusion coat of the fuel injector, the longitudinal rib being disposed on the fuel injector opposite a current bar. As a result, the fuel injector according to the present invention is able to be stiffened in an especially cost-effective manner and can be produced without any difficulty. Because of the opposite placement, the longitudinal rib constitutes a rectification with respect to the current bar.

The longitudinal rib preferably has a length that is at least as long as the current bar and, especially preferably, as long as the entire length of the extrusion coat in the axial direction of the fuel injector. This results in excellent stiffening of the fuel injector.

According to a further preferred specific embodiment of the present invention, a fuel supply element to be extrusion-coated is a pipe having a section that features a constant diameter; a ratio of an outer diameter of the section featuring a constant cross-section to a length of the section featuring the constant diameter in the axial direction amounts to at least 1:2.5, preferably at least 1:10, and preferably approximately 1:14.5.

To further improve the stiffening, the longitudinal rib preferably has multiple transverse ribs. The transverse ribs are preferably disposed at identical intervals in the longitudinal direction.

The longitudinal rib preferably has a T-shape in cross-section. This makes it possible to achieve especially satisfactory stiffening of the longitudinal rib. A maximum width of the T-shape of the longitudinal rib is preferably greater than or equal to a maximum width of the extrusion coat at the current bar.

According to one further preferred specific embodiment of the present invention, a reinforcement is additionally injected into the longitudinal rib. This results in an even better stiffening function of the longitudinal rib. Placing a reinforcement in the longitudinal rib has the additional advantage that warping of the longitudinal rib in a cooling behavior following the extrusion coating is the same on both sides. The reinforcement is preferably selected in such a way that the reinforcement has the same cross-section as a cross-section of the current bar. Especially preferably, the reinforcement is a second current bar, in which case the second current bar need not be carrying current, but simply serve as stiffening device. According to one alternative development of the present invention, the longitudinal rib furthermore includes a second current bar, which is designed to carry current. This makes it possible to provide the first current bar, which usually includes a first and a second electrical line, with precisely only one current line, and a return line is provided through the second current bar in the longitudinal rib.

In a furthermore preferred manner, a maximum width of the longitudinal rib in cross-section is equal in size or greater than a maximum width of the extrusion coat in the region of the current bar. This defines a certain minimum width of the longitudinal rib, which ensures sufficient rigidity for the fuel injector in all installation situations. A cross-section of the longitudinal rib is especially preferably rectangular. The longitudinal rib thus has an I-profile in cross-section. This I-profile is able to be produced in a particularly simple and cost-effective manner.

Furthermore, the fuel injector is preferably a solenoid valve.

The present invention also relates to an internal combustion engine, which includes a fuel injector according to the present invention, the fuel injector being situated in a cylinder head for the direct injection of fuel into a combustion chamber. Thus, there is no difficulty in guiding the fuel injector of the present invention through the cylinder head to the combustion chamber from above. Warping is therefore able to be avoided even in the case of long fuel injectors by providing the extrusion coat.

The fuel injector according to the present invention especially preferably is used in internal combustion engines of vehicles featuring direct injection. In particular, the fuel injector according to the invention is a fuel injector which injects gasoline.

BRIEF DESCRIPTION OF THE DRAWINGS

Preferred exemplary embodiments of the present invention are described in detail below, with reference to the accompanying figures. Identical or functionally equivalent parts are designated by the same reference numerals.

DETAILED DESCRIPTION OF EXAMPLE EMBODIMENTS

Figure 1:
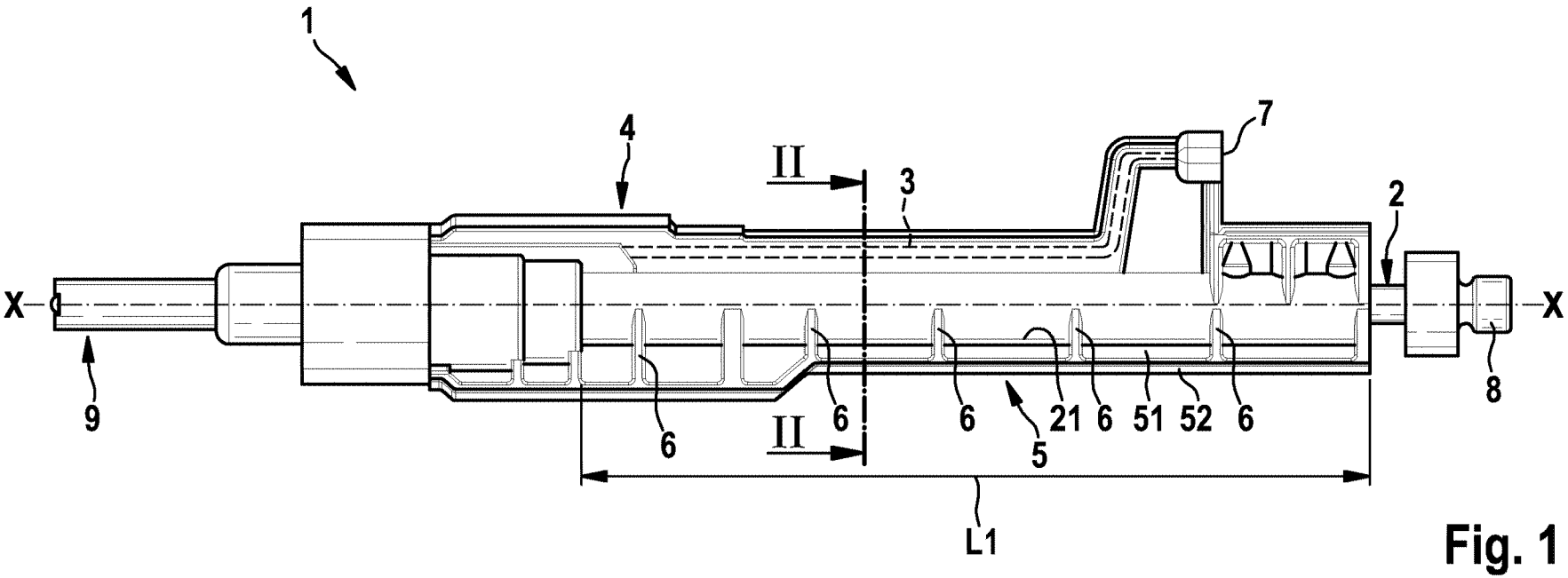
FIG. 1 shows a schematic side view of a fuel injector according to a first embodiment of the present invention.
Figure 2:
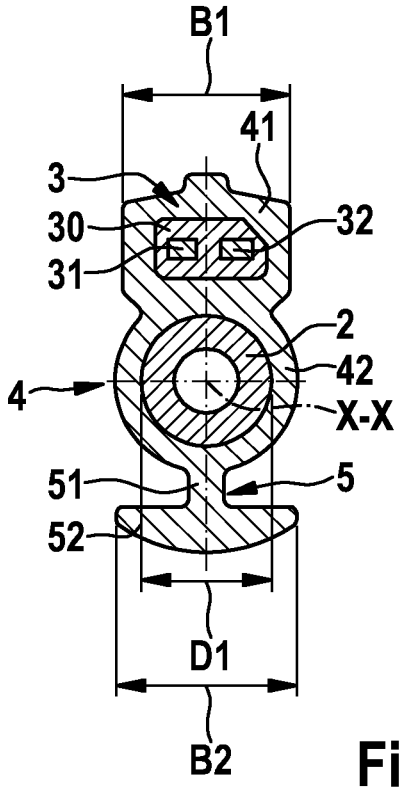
FIG. 2 shows a schematic sectional view along line II-II of FIG. 1.

With reference to FIGS. 1 and 2, a fuel injector 1 according to a first preferred exemplary embodiment of the present invention is described in detail below.

As is shown in FIGS. 1 and 2, the fuel injector includes a central fuel supply element 2, which is a pipe in this exemplary embodiment. Fuel supply element 2 runs through the fuel injector in axial direction X-X of fuel injector 1. Reference numeral 8 denotes a connecting piece, which enables a hydraulic connection to a fuel line. Reference numeral 9 denotes an injection-side end of the fuel injector, from which the fuel is injected directly into a combustion chamber.

In addition, fuel injector 1 includes an electrical connection 7, which is developed as a plug connector and set up for the electrical contacting with a current source. Electrical connection 7 is connected to an electrical consumer via a current bar 3. In this exemplary embodiment, the electrical consumer is an electromagnetic actuator which actuates a valve-closure element. Current bar 3 includes a first line 31 and a second line 32, which are surrounded by insulation 30 (see FIG. 2).

In addition, fuel injector 1 includes an extrusion coat 4, which surrounds both fuel supply element 2 and current bar 3. This is especially clear from the sectional view of FIG. 2. Extrusion coat 4 includes an extrusion region 41 for current bar 3, and an extrusion region 42 for fuel supply element 2. Moreover, extrusion coat 4 has a longitudinal rib 5. Longitudinal rib 5 has a length that corresponds to an overall length of extrusion coat 4 in the axial direction (center axis X-X). Longitudinal rib 5 runs parallel to a section 21 of fuel supply element 2 featuring a constant outer diameter D1. Section 21 having constant outer diameter D1 has a length L1. A ratio of outer diameter D1 of section 21 to length L1 of section 21 amounts to approximately 1:14.5.

As can be gathered from FIG. 2 in particular, longitudinal rib 5 has a generally T-shaped design in cross-section, and a connection region 51 for a connection to second extrusion region 42 for fuel supply element 2, and a T-region 52. T-region 52 has an arched outer surface and a maximum width B2 in cross-section. This maximum width B2 corresponds to a maximum width B1 of first extrusion region 51 at current bar 3. Longitudinal rib 5 thus forms a static support rib, which is disposed opposite current bar 3 starting from center axis X-X. First and second extrusion regions 41, 42 and longitudinal rib 5 are preferably extruded in a single injection step. In this way, no warping is able to occur by extrusion coat 4 during cooling of the extrusion coat mass, so that an uncomplicated concentric installation of fuel injector 1 is possible.

Longitudinal rib 5 therefore runs parallel to center axis X-X and parallel to current bar 3. At identical intervals, transverse ribs 6 are furthermore provided on longitudinal rib 5, which further increase the stability of longitudinal rib 5. As a result, no separate components are required for the additional reinforcement in the present invention, but only a slightly larger quantity of extrusion mass. This makes it possible to ensure concentricity of the fuel injector with respect to center axis X-X.

Figure 3:
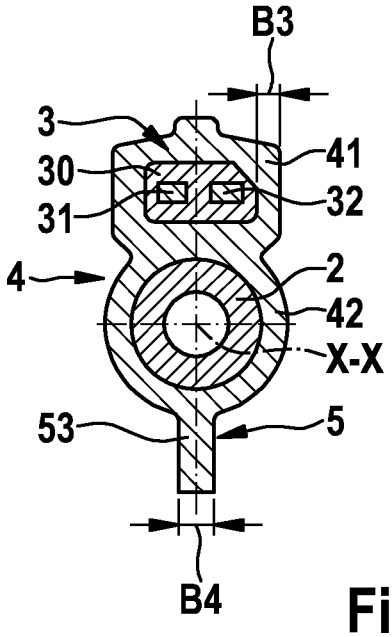
FIG. 3 shows a schematic sectional view of a fuel injector according to a second exemplary embodiment of the present invention.

FIG. 3 shows a section through a fuel injector 1 according to a second exemplary embodiment of the present invention. In the second exemplary embodiment, longitudinal rib 5 has a rectangular form in cross-section and thus an I-form 53. Longitudinal rib 5 once again extends across the entire maximum length of extrusion coat 4 in the axial direction of the fuel injector. By selecting the I-profile, it is possible to provide a longitudinal rib 5 that exerts a tensile load on extrusion coat 4 during the cooling process. In this context, a width B4 of longitudinal rib 5 is equal to a width B3 of first extrusion region 41 at current bar 3. Since greater shrinkage behavior of longitudinal rib 5 is present due to the relatively great width B4 and the resulting relatively large quantity of extrusion material, it is possible to actively straighten fuel injector 1 during the cooling process of the extrusion coat.

Figure 4:
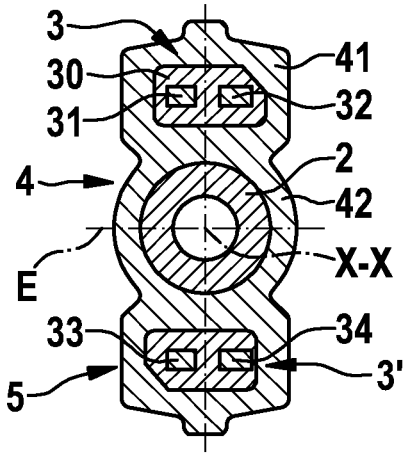
FIG. 4 shows a schematic sectional view of a fuel injector according to a third exemplary embodiment of the present invention.

FIG. 4 shows a cross-section of a fuel injector 1 according to a third exemplary embodiment of the present invention. Here, a second current bar 3' is additionally disposed in longitudinal rib 5. Second current bar 3' has a first currentless line 33 and a second currentless line 34. As indicated by plane E through center axis X-X, in this embodiment, the extrusion region on a first side of plane E is to be identical with an extrusion region on the second side of the plane. In this way extrusion coats having the same properties on both sides of plane E are able to be achieved, so that very precise fuel injectors without warping are able to be produced in this third exemplary embodiment. To do so, however, a second, non-current-carrying current bar 3' must be injection-molded as well, which has no electrical function but simply provides a compensating function for an identical behavior of extrusion coat 4 on both sides of plane E.

Figure 5:
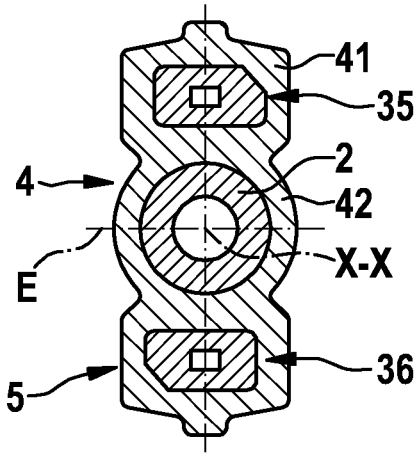
FIG. 5 shows a schematic sectional view of a fuel injector according to a fourth exemplary embodiment of the present invention.

In FIG. 5, which shows a section through a fourth exemplary embodiment, a first current bar 35 and a second current bar 36 are co-injected into extrusion coat 4. Second current bar 36 is injected into longitudinal rib 5. This makes it possible for fuel injector 1 to provide an exact mirror image to center plane E, so that the two sides have an identical design relative to plane E. Warping of the fuel injector is avoided in this manner, and a concentrically produced fuel injector 1 is able to be provided. First current bar 35 serves as the electrical supply line, and second current bar 36 assumes the electrical return line, so that each one of the two current bars 35, 36 has an electrical function. This makes it possible to reduce the component cost, especially in comparison with the third exemplary embodiment.

Fuel injector 1 according to the present invention and described in the exemplary embodiments is a fuel injector having a magnetic actuator. In particular, a perpendicular installation of the fuel injector, through a cylinder head, is able to be realized in this manner. Especially so-called long fuel injectors having a ratio of an outer diameter D1 to a length L1 of a section 21 featuring a constant outer diameter of greater than, or equal to, 1:2.5 are able to be realized without any concentricity problems. The approach according to the present invention is able to be implemented in a very simple and cost-effective manner and, in particular, is extremely well suited to mass production.

What is claimed is:

1. A fuel injector for injecting fuel, comprising:

a fuel supply element having a fuel channel extending between a first end of the fuel injector and a second end of the fuel injector along an axial direction to carry the fuel from a hydraulic fuel connector at the first end of the fuel injector and an injection point at the second end of the fuel injector along the axial direction;

a current bar which extends from an electrical connection to an electromagnetic actuator, the current bar extending at least partially parallel to and side-by-side with the fuel channel of the fuel supply element carrying the fuel along the axial direction, and the current bar being situated adjacent to a first side of the fuel channel of the fuel supply element; and an extrusion coat coated onto the fuel supply element and current bar to envelop the fuel supply element and the current bar, the extrusion coat including a longitudinal rib which extends at least partially parallel to and side-by-side with the fuel channel of the fuel supply element carrying the fuel along the axial direction, the longitudinal rib being situated adjacent to a second side of the fuel channel of the fuel supply element opposite to the first side, the fuel channel of the fuel supply element being situated between the current bar and the longitudinal rib.

2. The fuel injector as recited in claim 1, wherein the longitudinal rib has a length that is at least as long as a length of the current bar in the axial direction.

3. The fuel injector as recited in claim 1, wherein a ratio of an outer diameter of a section of the fuel supply element having a constant outer diameter, to a length of the section in the axial direction is greater than or equal to 1:2.5.

4. The fuel injector as recited in claim 3, wherein the ratio is greater than or equal to 1:10.

5. The fuel injector as recited in claim 3, wherein the ratio is greater than or equal to 1:14.5.

6. The fuel injector as recited in claim 1, wherein the longitudinal rib includes a plurality of transverse ribs disposed at intervals.

7. The fuel injector as recited in claim 1, wherein in cross-section, the longitudinal rib has a T-shape including a connection region and a T-region.

8. The fuel injector as recited in claim 7, wherein a maximum width of the T-region is greater than or equal to a maximum width of the extrusion coat on the current bar.

9. The fuel injector as recited in claim 1, wherein the longitudinal rib includes a reinforcement.

10. The fuel injector as recited in claim 9, wherein the reinforcement has the same cross-section as a cross-section of the current bar.

11. The fuel injector as recited in claim 1, wherein in cross-section, a maximum width of the longitudinal rib is greater than a maximum width of the extrusion coat in a region of the current bar.

12. The fuel injector as recited in claim 11, wherein the longitudinal rib has a rectangular cross-section.

13. An internal combustion engine, comprising:

a fuel injector which is disposed in a cylinder head for a direct injection of fuel into a combustion chamber, the fuel injector including:

a fuel supply element having a fuel channel extending between a first end of the fuel injector and a second end of the fuel injector along an axial direction to carry the fuel from a hydraulic fuel connector at the first end of the fuel injector and an injection point at the second end of the fuel injector along the axial direction;

a current bar which extends from an electrical connection to an electromagnetic actuator, the current bar extending at least partially parallel to and side-by-side with the fuel channel of the fuel supply element carrying the fuel along the axial direction, and the current bar being situated adjacent to a first side of the fuel channel of the fuel supply element; and an extrusion coat coated onto the fuel supply element and current bar to envelop the fuel supply element and the current bar, the extrusion coat including a longitudinal rib which extends at least partially parallel to and side-by-side with the fuel channel of the fuel supply element carrying the fuel along the axial direction, the longitudinal rib being situated on an opposite side of the fuel channel of the fuel supply element from the current bar, the fuel channel of the fuel supply element being situated between the current bar and the longitudinal rib.

14. The internal combustion engine of as recited in claim 13, wherein the longitudinal rib has a length that is at least as long as a length of the current bar in the axial direction.

15. The internal combustion engine as recited in claim 13, wherein the longitudinal rib includes a plurality of transverse ribs disposed at intervals.

16. The internal combustion engine as recited in claim 13, wherein in cross-section, the longitudinal rib has a T-shape including a connection region and a T-region.

17. The internal combustion engine as recited in claim 13, wherein the longitudinal rib includes a reinforcement.

18. The fuel injector as recited in claim 9, wherein the reinforcement includes a second current bar.

19. The fuel injector as recited in claim 1, wherein the longitudinal rib has a length that is at least as long as a length of the extrusion coat in the axial direction.

20. The fuel injector as recited in claim 1, wherein the fuel supply element is a fuel supply pipe having the fuel channel.

21. The fuel injector as recited in claim 1, wherein the fuel supply element is a pipe-shaped fuel supply element having the fuel channel.

22. The internal combustion engine as recited in claim 13, wherein the fuel supply element is at least one of: a fuel supply pipe having the fuel channel, or a pipe-shaped fuel supply element having the fuel channel.

* * * * *